US010764977B2

(12) United States Patent
Ferrell

(10) Patent No.: US 10,764,977 B2
(45) Date of Patent: Sep. 1, 2020

(54) LED LIGHT TEMPERATURE CONTROL

(71) Applicant: ITC Incorporated, Hudsonville, MI (US)

(72) Inventor: Dirrick Ferrell, Hudsonville, MI (US)

(73) Assignee: ITC Incorporated, Hudsonville, MI (US)

( * ) Notice: Subject to any disclaimer, the term of this patent is extended or adjusted under 35 U.S.C. 154(b) by 0 days.

(21) Appl. No.: 16/377,602

(22) Filed: Apr. 8, 2019

(65) Prior Publication Data

US 2019/0313496 A1 Oct. 10, 2019

Related U.S. Application Data

(60) Provisional application No. 62/653,941, filed on Apr. 6, 2018.

(51) Int. Cl.
*H05B 45/10* (2020.01)

(52) U.S. Cl.
CPC ..... *H05B 45/10* (2020.01)

(58) Field of Classification Search
None
See application file for complete search history.

(56) References Cited

U.S. PATENT DOCUMENTS 5,982,159 A * 11/1999 Janczak ..... H05B 41/2856 315/247
7,288,902 B1 10/2007 Melanson
8,570,160 B2 * 10/2013 Speegle ..... G08C 19/02 340/12.32
2016/0088697 A1 * 3/2016 Yan ..... H05B 33/0818 315/205
2018/0027626 A1 * 1/2018 Wang ..... H05B 33/0815 315/186

* cited by examiner

*Primary Examiner* — Dedei K Hammond
(74) *Attorney, Agent, or Firm* — Varnum, Riddering, Schmidt & Howlett LLP

(57) ABSTRACT

An LED light temperature control system includes a dimmer switch comprising a single power input, an output signal, and an control device configured to vary the duty cycle of the output signal. The LED light temperature control system further includes a light controller configured to receive the output signal from the dimmer switch. The light controller has a first light output signal configured to power a first group of LEDs and a second light output signal configured to power a second group of LEDs. The light controller is configured to vary the duty cycle of the first light output signal proportionate to the duty cycle of the dimmer switch output signal. The light controller is further configured to vary the duty cycle of the second light output signal inversely to the duty cycle of the dimmer switch output signal.

10 Claims, 5 Drawing Sheets

LED LIGHT TEMPERATURE CONTROL

CROSS-REFERENCE TO RELATED APPLICATION

This application claims priority to U.S. Provisional Patent Application No. 62/653,941 filed on Apr. 6, 2018 and entitled LED LIGHT TEMPERATURE CONTROL, which is hereby incorporated by reference

FIELD OF INVENTION

The present invention generally relates to a system and method for adjusting the color temperature of an LED light.

BACKGROUND

Light emitting diodes (LEDs) have many advantages over traditional lighting sources, such as tubular fluorescent lights, incandescent lights, or high intensity discharge lights. These advantages include high light-electricity conversion rate, small volume, long life, adopting DC current, fixed wavelength low heat generation, and complying with environmental protection requirements. For these reasons, LEDs have become a popular illumination device.

In some applications, it may be desirable to vary the color temperature of the LED lighting, such as varying the light from a cooler temperature (i.e. blue and purple hues) to warmer temperature (i.e. orange and red hues). This may be done by providing two or more banks of LEDs having distinct light frequencies, one that emits warmer light and one that emits cooler light. By dimming one bank of LEDs and brightening the other (or vice versa) the overall light emitted may be faded between warm and cool temperatures.

In systems that employ three or more wires to power and control an LED light this fading may be accomplished with ease by providing a dedicated power wire to the LEDs and providing power intensity signals to dim and brighten the lights. However, when a dedicated power wire is unavailable, such as is the case in certain RV and Marine applications, controlling variation in color temperature is more difficult.

Accordingly, an improved LED light temperature control circuit and method for making and employing the same is needed.

SUMMARY

An LED light temperature control system is generally presented. The LED light temperature control system includes a dimmer switch comprising a single power input, an output signal, and an control device configured to vary the duty cycle of the output signal. The LED light temperature control system further includes a light controller configured to receive the output signal from the dimmer switch. The light controller has a first light output signal configured to power a first group of LEDs and a second light output signal configured to power a second group of LEDs. The light controller is configured to vary the duty cycle of the first light output signal proportionate to the duty cycle of the dimmer switch output signal. The light controller is further configured to vary the duty cycle of the second light output signal inversely to the duty cycle of the dimmer switch output signal.

In an embodiment, the two groups of LEDs have distinct color temperatures, such as 1800 Kelvin and 3000 Kelvin.

In an embodiment the dimmer switch may include an on/off switch to control the dimmer output signal. The dimmer switch may further include a linear slide to act as the control device. The dimmer switch may be configured to vary the duty cycle of the output signal between 10 percent and 100 percent.

BRIEF DESCRIPTION OF THE DRAWINGS

The operation of the invention may be better understood by reference to the detailed description taken in connection with the following illustrations, wherein.

DETAILED DESCRIPTION

Reference will now be made in detail to exemplary embodiments of the present invention, examples of which are illustrated in the accompanying drawings. It is to be understood that other embodiments may be utilized and structural and functional changes may be made without departing from the respective scope of the invention. Moreover, features of the various embodiments may be combined or altered without departing from the scope of the invention. As such, the following description is presented by way of illustration only and should not limit in any way the various alternatives and modifications that may be made to the illustrated embodiments and still be within the spirit and scope of the invention.

Figure 1:
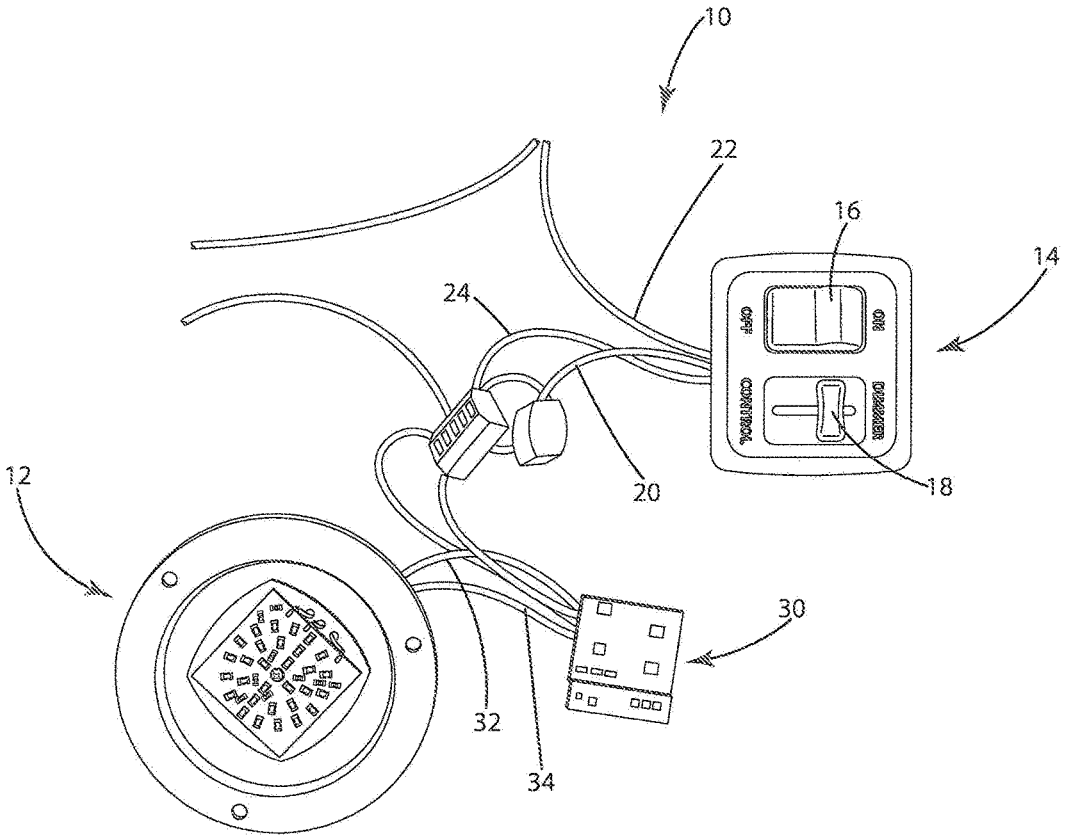
FIG. 1 illustrates an LED light temperature control circuit.
Figure 2:
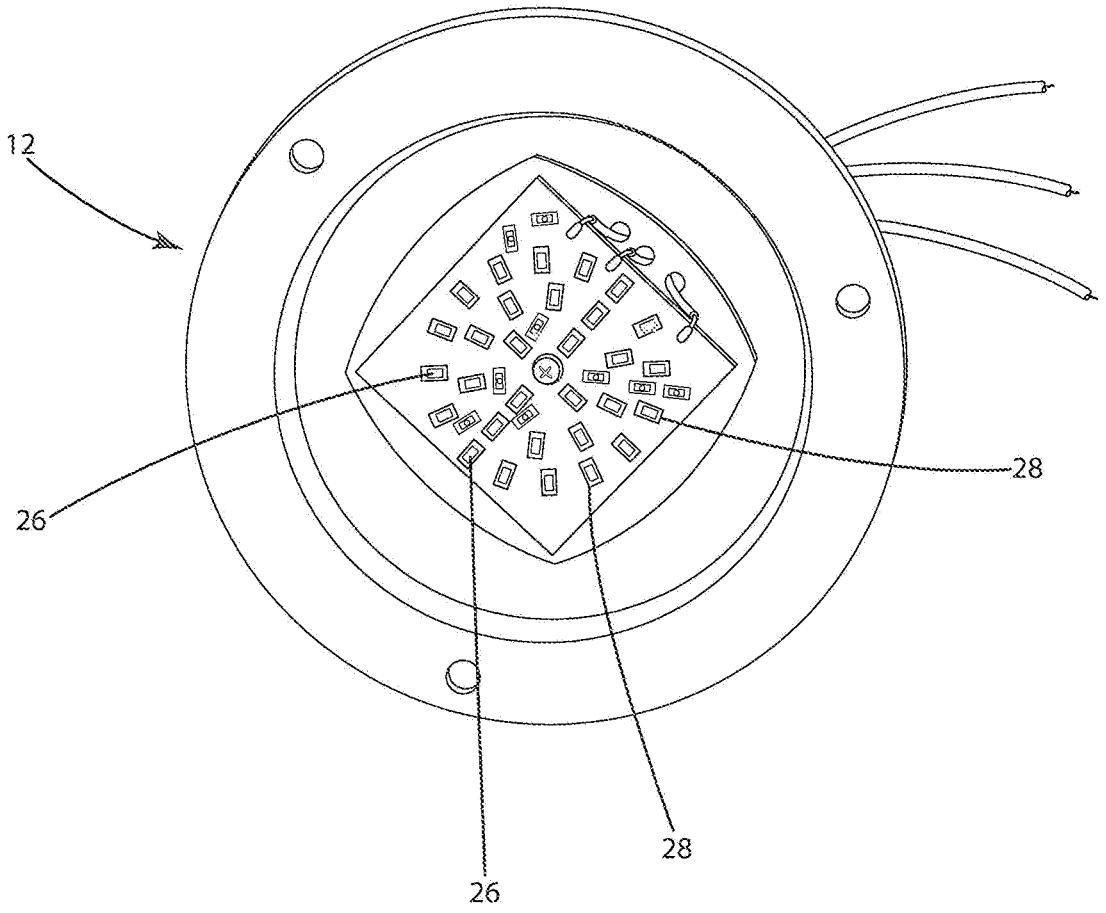
FIG. 2 illustrates a light source having two LED banks configured to emit light at two unique frequencies.

An LED light temperature control circuit 10 is generally presented, as shown in FIG. 1. The control circuit 10 may be generally configured to adjust the output of a light source 12 between a first color frequency and a second color frequency, such as between a cooler color temperature and a warmer color temperature, while also dimming the brightness or intensity of the light.

Figure 3:
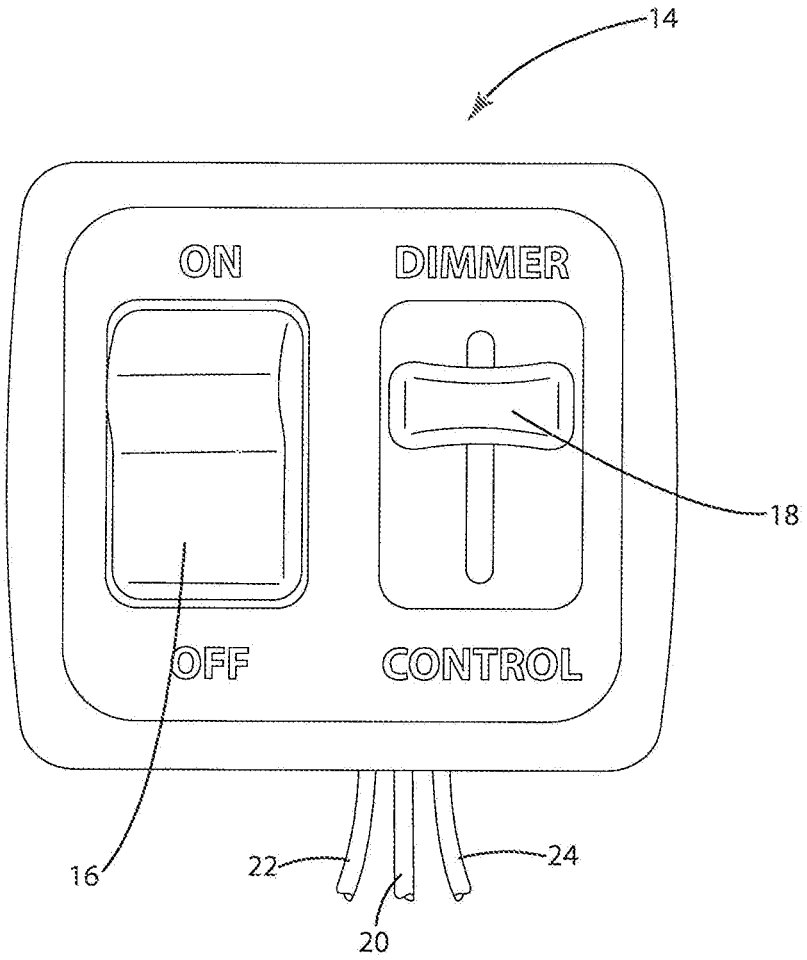
FIG. 3 illustrates a two wire dimmer switch used in an LED light temperature control circuit.

The control circuit 10 may include a dimmer 14. The dimmer 14 may be a two wire dimmer, such as is commonly used in RV and marine applications. As shown in FIG. 3, the dimmer 14 may include an ON/OFF switch 16 to turn output power off and a dimmer control 18 to provide adjustability of the output signal. The dimmer control 18 may comprise a linear slide, as shown in FIG. 3, to vary the duty cycle or pulse width modulation ("PWM") of the output signal. It will be appreciated that the dimmer control may be any analog device, such as a dial or the like, or digital device that varies the PWM of the output signal.

The two-wire dimmer 14 may be generally configured to vary the duty cycle of the output to the light source 12 to vary the brightness or intensity of the light. As described below, the dimmer 14 and other system components may be configured to simultaneously vary the color temperature of the light source 12 from cooler to warmer light temperature as the light source 12 is dimmed, as described in further detail below.

The two-wire dimmer 14 may be configured to receive a single power input 22 and provide a single output signal 20. The input, shown as wire 22 in FIG. 1, may comprise a DC voltage such as a 12 volt DC signal. The common or ground wire 24 may also connected to the dimmer 14 and may also connect to each component in the control circuit 10. The output signal 20 may be controlled by the ON/OFF switch 16 and dimmer switch 18 on the dimmer 14. Specifically, duty cycle of the dimmer output 20 may be varied by adjusting the dimmer slider switch 18. For example, the dimmer 14 may output a 12 volt DC signal between a 10% and 100% duty cycle on the output wire 20 based on movement of the slider between its range of travel. In traditional systems the varied duty cycle may be used vary only the intensity of one or more LEDs by changing the amount of time that the LED is on and thus dimming or brightening the connected lights. At lower duty cycles the LEDs may be dimmer and at higher duty cycles the LEDs may be brighter. Here, LED light temperature control circuit 10 may adjust both the brightness or intensity of the light source 12 as well as the color temperature when the duty cycle is varied.

The light source 12 in the control circuit may comprise two or more distinct LEDs or two or more distinct groups of LEDs. For example, the light source 12 may include a first group of LEDs 26 that operate at a first light temperature, such as 1800 Kelvin to emit warmer light, and a second group of LEDs 28 that operate at a second light temperature, such as 3000 Kelvin. However, it will be appreciated that the two or more distinct LED's or groups of LEDs may operate at any two distinct light temperatures to provide a cooler light temperature and a warmer light temperature. Each group of LEDs 26, 28 may be configured to receive a DC signal to power the LEDs and may be varied in brightness by varying the duty cycle of the input power signal.

Figure 4:
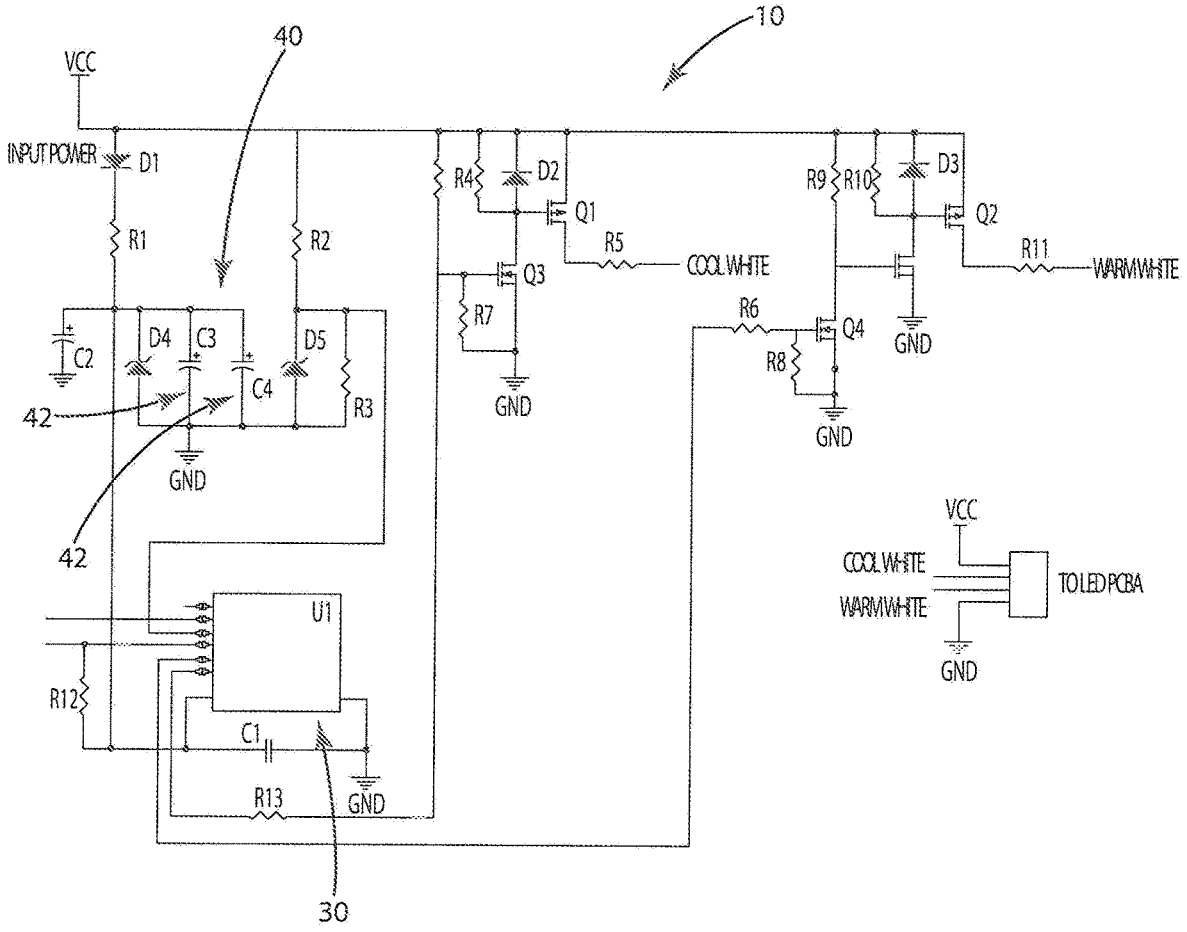
FIG. 4 illustrates a circuit diagram for a LED light temperature control circuit.
Figure 5:
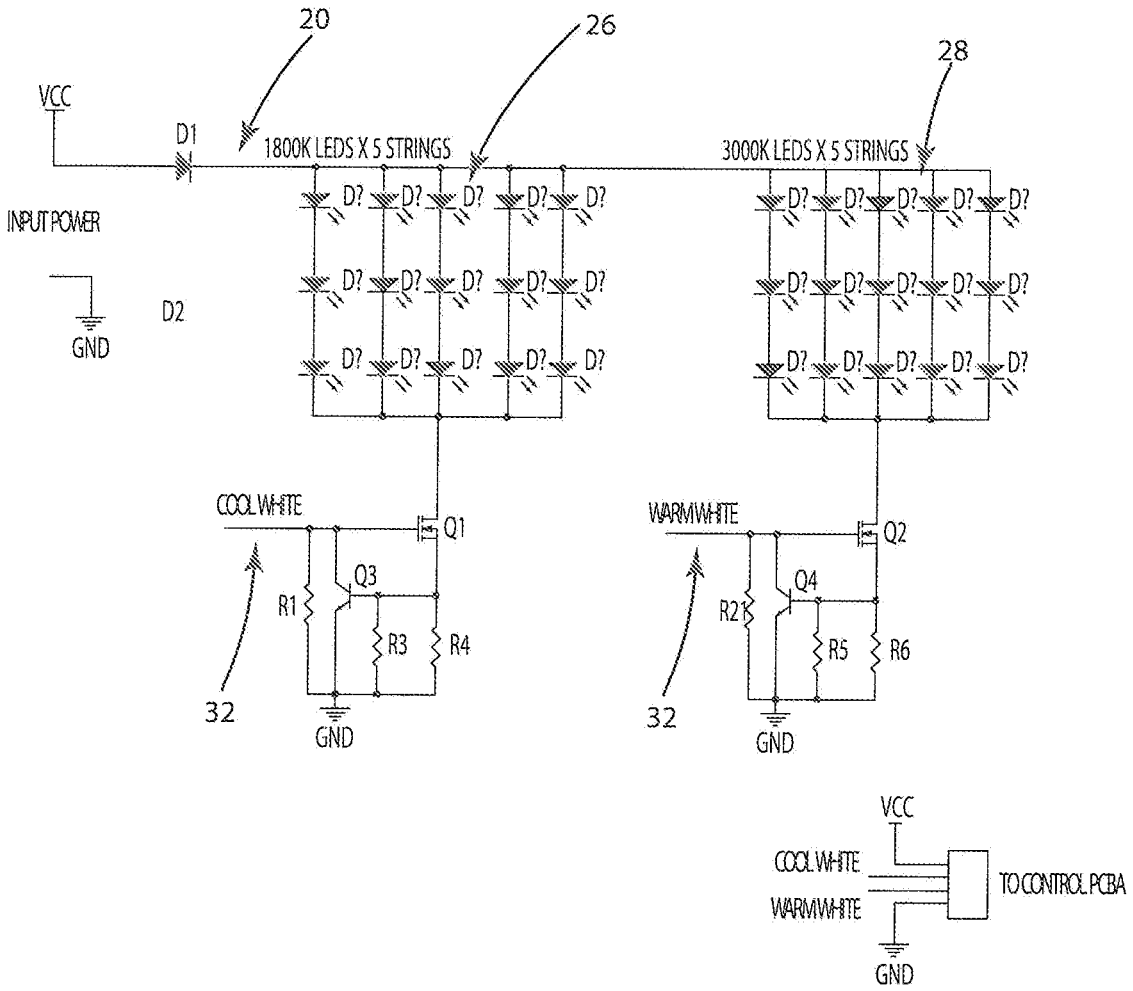
FIG. 5 illustrates a circuit diagram for an LED light source in an LED light temperature control circuit.

The control circuit 10 may further include a controller 30, as illustrated in FIG. 4. The controller 30 may be powered by the dimmer output 20 and may provide separate power and control signals to each bank of LEDs 26, 28 on the light source 12. The first controller output 32 may be tied to the first bank of LEDs 26 and the second controller output 34 may be tied to the second back of LEDs 28.

In operation, dimming the two-wire dimmer 14 will decrease the duty cycle of the power input to the controller 30, thus causing the controller 30 to lose power sporadically. In order to maintain consistent power to the controller, a voltage buffer circuit 40 comprising a plurality of capacitors 42 may be used to buffer the input power to the controller 30. The voltage buffer circuit 40 maintains the voltage at a high condition, even during low duty cycles, thus providing consistent power to the controller 30 even while the duty cycle of the output 20 is varied. When the voltage is too low the light will default to using the warm LEDs only.

The controller 30 may use the output 20 of the dimmer 14 as both input power and as an input signal to the controller 30 to monitor the duty cycle of the output signal 20. The controller 30 may be configured to vary the duty cycle of the first controller output 32 in an opposite manner to the second controller output 34, based on the duty cycle of the dimmer output 20. For example, the controller 30 may read the duty cycle of the dimmer output 20 to determine the desired light temperature for the light source 12. When the dimmer output 20 is at a high duty cycle the controller 30 will output a high duty cycle signal to the first controller output 32 and a low duty cycle signal to the second controller output 34, yielding a bright output from the first bank of LEDs 26 and dimmed output from the second bank of LEDs 28 to provide a cooler light temperature of the light source 12. As the dimmer output 20 is adjusted and the duty cycle is lowered, the controller 30 will lower the duty cycle of the first controller output 32 and raise the duty cycle of the second controller output 34, thus dimming the first bank of LEDs and brightening the second bank of LEDs 28 to adjust the light source output from cool light temperature to a warmer light temperature.

In operation, the control circuit 10 may be connected as illustrated in FIG. 1. The controller 30 may be stored in the assembly of the light source 12 to allow for a simple two-wire connection between the dimmer 14 and the light source. When the ON/OFF switch 16 is initially turned on, the controller 30 may be configured to first provide a high duty cycle to the first bank of LEDs 26 and a low duty cycle to the second bank of LEDs 28 (yielding an initial warmer light temperature) then may automatically vary the light output to cool by varying the duty cycles of the first and second banks of LEDs 26, 28 in opposite directions. Once this initial boot up sequence is complete, a user may adjust the color temperature of the light source 12 by varying the dimmer slider switch 18 along its path of travel.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The claims as follows are intended to include all modifications and alterations insofar as they come within the scope of the claims or the equivalent thereof.

The invention claimed is:

1. An LED light temperature control system comprising:
- a dimmer switch comprising;
  - a single direct current ("DC") power input;
  - an output signal; and
  - an control device configured to vary the duty cycle of the output signal;
- a light controller configured to receive the output signal from the dimmer switch, the light controller comprising:
  - a first light output signal to a first group of LEDs; and
  - a second light output signal to a second group of LEDs;
- wherein the light controller is configured to vary the duty cycle of the first light output signal proportionate to the duty cycle of the dimmer switch output signal;
- wherein the light controller is configured to vary the duty cycle of the second light output signal inversely to the duty cycle of the dimmer switch output signal; and
- wherein the power input to the light controller is reduced as the duty cycle of the output signal from the dimmer switch is reduced.

2. The LED light temperature control system of claim 1, wherein the color temperature of the first group of LEDs is different than the color temperature of the second group of LEDs.

3. The LED light temperature control system of claim 2, wherein the light temperature of the first group of LEDs is 1800 Kelvin.

4. The LED light temperature control system of claim 2, wherein the light temperature of the second group of LEDs is 3000 Kelvin.

5. The LED light temperature control system of claim 1 further comprising an on/off switch on the dimmer switch, wherein the on/off switch is configured to turn off the dimmer switch output signal when in off position.

6. The LED light temperature control system of claim 1 wherein the device configured to vary the duty cycle of the output signal comprises a linear slide.

7. The LED light temperature control system of claim 1 wherein the dimmer switch is configured to vary the duty cycle of the dimmer switch output signal between 10 percent and 100 percent.

8. The LED light temperature control system of claim 1 wherein the light controller includes a voltage buffer circuit to assist in maintaining power to the controller when the dimmer output signal is at a duty cycle less than 100 percent.

9. The LED light temperature control system of claim 1, wherein the dimmer switch includes no electrical connections other than the single power input, the dimmer switch output signal, and a common or ground connection.

10. The LED light temperature control system of claim 1, wherein the light controller is configured to use the dimmer output signal to provide power and to read the duty cycle of the dimmer output signal.

* * * * *